United States Patent [19]

Floreancig

[11] Patent Number: 4,510,122

[45] Date of Patent: Apr. 9, 1985

[54] PROCESS FOR EXTRACTING URANIUM FROM PHOSPHORIC ACIDS BY MEANS OF ALKYLPYROPHOSPHORIC ACIDS

[75] Inventor: Antoine Floreancig, St Genis Laval, France

[73] Assignee: Uranium Pechiney Ugine Kuhlmann, Paris, France

[21] Appl. No.: 511,478

[22] Filed: Jul. 7, 1983

[30] Foreign Application Priority Data

Jul. 30, 1982 [FR] France ..... 82 13820

[51] Int. Cl.[3] ..... C01G 43/00

[52] U.S. Cl. ..... 423/10; 423/8

[58] Field of Search ..... 423/8, 10

[56] References Cited

U.S. PATENT DOCUMENTS

| | | | |
|---|---|---|---|
| 4,154,698 | 5/1979 | Doft | 423/8 |
| 4,180,545 | 12/1979 | McCullough et al. | 423/8 |
| 4,243,637 | 1/1981 | Bradford et al. | 423/8 |
| 4,282,188 | 8/1981 | Demarthe et al. | 423/10 |
| 4,287,071 | 9/1981 | DiGiacomo | 423/8 |
| 4,292,278 | 9/1981 | Elikan et al. | 423/10 |
| 4,293,529 | 10/1981 | Reese et al. | 423/10 |
| 4,311,676 | 1/1982 | Demarthe et al. | 423/10 |

*Primary Examiner*—Edward A. Miller

*Attorney, Agent, or Firm*—McDougall, Hersch & Scott

[57] ABSTRACT

A process for extracting the uranium contained in phosphoric acid solutions by means of an extracting agent comprising an alkylpyrophosphoric acid, which comprises bringing into contact, in an agitated condition, the inorganic, phosphoric acid phase and an organic phase containing the extracting agent, thereby producing an emulsion, which is characterized in that, in an extraction unit comprising n stages in a cascade configuration, for each extraction stage, the emulsion is produced in a first step by simultaneously subjecting the two phases for a period of time $T_1$ to an intense mechanical shearing action corresponding to a shearing coefficient of at least 5000 seconds$^{-1}$ in order to multiply the contact surfaces for contact between said two phases, and then said emulsion in a second step is abruptly broke in a time $T_2$, the sum of the times required for carrying out the two steps being at most 20 minutes.

16 Claims, No Drawings

PROCESS FOR EXTRACTING URANIUM FROM PHOSPHORIC ACIDS BY MEANS OF ALKYLPYROPHOSPHORIC ACIDS

The present invention concerns an improved process for extracting the uranium which is present in phosphoric acid solutions, by means of an agent comprising alkylpyrophosphoric acids, which process permits said agent to preserve its extracting capability in the course of time, while limiting degradation thereof.

For a long time now, as shown by the large number of publications in this field, a great deal of research has been carried out in order to find a process for extracting uranium from phosphoric acid solutions, which is the most suitable form of process and which has the highest level of performance.

Among the group of extraction processes, known at the present time, the man skilled in the art has concentrated on that which uses alkylpyrophosphoric acids as the uranium extracting agent, which is employed in a solubilised form, in an organic diluent such as a petroleum cut, kerosine, etc, the most widely used extracting agent being alkylpyrophosphoric acid which is produced by the reaction of $P_2O_5$ on octan-2-ol.

Among the large amount of research carried out in this field, reference may be made to the work done by R S Long which is embodied in the report of Geneva Conferences from Aug. 8–20, 1955, volume VIII, page 524, on the 'recovery of uranium from phosphates by extraction by means of solvents', and U.S. Pat. No. 2,866,680 concerning a process for extracting uranium in acid solution by means of a solvent formed by an alkyl pyrophosphoric acid.

According to the work carried out by R S Long, recovery of the uranium which is contained in phosphoric acid, in a proportion of from 90 to 200 milligrams of uranium oxide $U_3O_8$ per liter, firstly comprises bringing the phosphoric acid solution into contact with the extraction agent which most generally comprises octylpyrophosphoric acid in solution in kerosine, extraction of the uranium being effected in a counter-flow mode in a group of mixing and sedimentation tanks disposed in a cascade configuration. Then, from the discharge of the last sedimentation tank, the organic phase which contains the uranium-charged octylpyrophosphoric acid in solution, which is separated from the phosphoric acid solution, is treated by contact with hydrofluoric acid, giving uranium fluoride ($UF_4$) and octylpyrophosphoric acid from which the uranium has been removed.

It is a well-known fact that the attraction of using alkylpyrophosphoric acids as a uranium extracting agent, and more particularly octylpyrophosphoric acid, lies in their high degree of extracting capability, even when they are used in a highly dilute organic solution, which permits them to extract the uranium present, even in very small amounts, in solutions of phosphoric acids, with a very high yield.

However, when the operation of extracting uranium from solutions of phosphoric acids is carried out on an industrial scale by means of octylpyrophosphoric acid for example, it is known that, as soon as the uranium has been removed from the uranium extracting agent and that agent is recycled to the extraction operation, the uranium extracting agent no longer has its initial extracting capability, that is to say, the coefficient of extraction of that agent is reduced in comparison with its original value. In that case, it is necessary either to provide a make-up amount of alkylpyrophosphoric acid, in order to restore the extraction coefficient to a reasonable level, or it is even necessary to replace the whole of the exhausted extracting agent, with a fresh agent.

Many attempts have then been made in an effort to have alkylpyrophosphoric acids and in particular octylpyrophosphoric acid retain their initial extraction coefficient, when they are employed for extracting uranium from solutions of phosphoric acids. The various ways proposed to safeguard the extracting capability of that agent include the suggestion that the operation of re-extracting the uranium contained in the alkylpyrophosphoric acid used should be carried out not by means of hydrofluoric acid but by means of an alkaline solution since it was agreed that the uranium-charged alkylpyrophosphoric acid underwent hydrolysis on the part of the hydrofluoric acid, which is the usual re-extraction agent, giving phosphoric acid esters. However, other methods have also been proposed, such as that which comprises adding another substance, for example octan-2-ol or dibutylphosphate, to the extracting agent formed by an alkylpyrophosphoric acid, or using a uranium extracting agent formed by other alkylpyrophosphoric acids which are less sensitive to acid hydrolysis, or else reducing the extraction temperature, etc. It is in that line of development that French Pat. No. 2 423 545 describes a process for extracting uranium from solutions of phosphoric acid, in which the extracting agent is a diester of pyrophosphoric acid such as dicaproylpyrophosphate or dioctylpyrophosphate, wherein hydrolysis of said extracting agent would be greatly reduced, while the operation of re-extraction of the uranium present in the organic phase is effected by means of an alkaline solution and no longer by means of hydrofluoric acid.

However, in spite of the large number of methods proposed, it must be said that the operation of continuously extracting uranium of valency IV, on an industrial scale, by means of an alkylpyrophosphoric acid which is recycled after the uranium re-extraction step requires a substantial make-up amount of fresh alkylpyrophosphoric acid, in each cycle, and in many cases the make-up amount of acid involved may be more than half the extracting agent used in a cycle.

Faced with the virtual impossibility of maintaining or at least limiting the drop in extracting capability of alkylpyrophosphoric acids, upon coming into contact with solutions of phosphoric acids containing uranium, it has even been proposed, in U.S. Pat. No. 4,293,529, that the extracting agent should be completely degraded in each cycle by heating and then, after oxidation from $U_{IV}$ to $U_{VI}$, the uranium should be re-extracted by a phosphoric acid solution.

Continuing their research in this area, with a view to improving the process for extracting uranium from solutions of phosphoric acids by means of alkylpyrophosphoric acids, the applicants observed that the losses of extracting agent were the consequence not only of the action of hydrofluoric acid in the uranium re-extraction step, but also the action of phosphoric acid (and impurities therein), when it is brought into contact with the extracting agent, and the magnitude and the criticality of the nature of such phenomenon is in direct proportion to the length of the contact time.

Therefore, being strongly aware of the above-indicated disadvantages and the phenomena that the applicants were able to study, the applicants, by virtue of their research, found and developed an improved process for extracting the uranium contained in solutions of phosphoric acids, by means of an extracting agent selected from the group comprising alkylpyrophosphoric acids, which makes it possible to avoid degradation thereof by said hydrolysis, while preserving their extracting capability.

The process according to the invention for extracting the uranium contained in solutions of phosphoric acids by means of an extracting agent comprising an alkylpyrophosphoric acid, which comprises bringing into contact, in an agitated condition, the inorganic, phosphoric acid phase and an organic phase containing the extracting agent, thereby producing an emulsion, is characterised in that, in an extraction unit comprising n stages in a cascade configuration, for each extraction stage, the emulsion is produced in a first step by simultaneously subjecting the two phases, for a period of time $T_1$, to an intense mechanical shearing action corresponding to a shearing coefficient of at least 5000 seconds$^{-1}$, in order to multiply the contact surfaces for contact between said two phases, then said emulsion, in a second step, is abruptly broken in a time $T_2$, the sum of the times required for carrying out the two steps being at most 20 minutes.

It appeared in fact to the applicants, and their research confirmed it, that it is possible to effect extraction of uranium IV contained in solutions of phosphoric acids, by means of an alkylpyrophosphoric acid, with a yield of at least 98%, while enabling the recycled extracting agent to retain its full efficiency, with a make-up of fresh extracting agent which is 5 to 10 times less than in the prior-art processes, provided that an emulsion is energetically formed between the two organic and inorganic phases, in which the dimension of the particles is generally less than 45 microns, followed then by rapid separation of those two phases by breaking the equilibrium of the emulsion.

In general, the extracting agent comprises a number of stages n of from 2 to 20. However, in accordance with an alternative embodiment, the extracting unit may comprise a single stage, in which case n=1.

In order to arrive at the production of a suspension in which the particles are generally smaller than 45 microns, the organic and inorganic phases must be subjected to an intense mechanical shearing action corresponding to a very high shearing coefficient. In general, the shearing coefficient is selected to fall in the range of from 5000 seconds$^{-1}$ to 50 000 seconds$^{-1}$, but preferably in the range of from 10 000 seconds$^{-1}$ to 25 000 seconds$^{-1}$.

The sum of the periods of time required for carrying out the two steps according to the invention is preferably at most equal to 10 minutes, for an extraction stage.

In addition, the periods of time $T_1$ and $T_2$ for carrying out the two steps may vary within wide limits, and the ratio $T_1/T_2$ thereof may be selected to lie within the limits of 1/100 to 5/1 and preferably 1/25 to 2/1.

The emulsion formed between the organic and inorganic phases is produced in any way known to the man skilled in the art, which makes it possible rapidly and vigorously to produce the finest possible emulsion, in order to multiply the contact surfaces and to obtain a very high level of extraction efficiency.

In general, rapid separation of the organic and inorganic phases may be effected by physical means, using any known method for providing for rapid breaking of said emulsion.

Among the physical means for producing and then destroying the very fine emulsion of the organic and inorganic phases, and very quickly separating those phases, it is possible to use suitably adapted hydrocyclones, multi-stage centrifugal extractors or single-stage centrifugal extractors, which are disposed in a battery arrangement or array.

Likewise, and in order to reduce losses, the extracting agent which is entrained by the phosphoric acid from which the uranium has been removed may be recovered by a physical separation operation, for example, centrifuging, and combined with the extracting agent which is recycled after re-extraction of the uranium.

As stated, the uranium extracting agent is selected from the well-known group of alkyl pyrophosphoric acids, in which the alkyl radical is a carbon chain corresponding to $C_7$ to $C_{13}$ alcohols produced by oxo synthesis, such as octan-2-ol, ethylhexanyl or decanol. The alkylpyrophosphoric acid may be prepared in known manner by adding $P_2O_5$ to the above-mentioned alcohol, which is used alone or mixed with a hydrocarbon.

The temperature for preparation of the alkylpyrophosphoric acid is generally from 30° C. to 80° C. but preferably from 30° C. to 40° C.

The uranium extracting agent is generally dissolved in an aliphatic and/or aromatic hydrocarbon, for example kerosines. The mixture which is formed in that way constitutes the organic uranium extracting phase, containing from 5 to 100 g/l but preferably from 20 to 50 g/l of alkylpyrophosphoric acid.

In practice, the solutions of phosphoric acids, which are produced by the attack on phosphate-bearing ores, generally contain from 30 to 200 milligrams of uranium per liter, such uranium being in the form $U_{IV}$ in regard to one part and in the form $U_{VI}$ in regard to the other part.

Uranium VI is then reduced to uranium IV by treating the phosphoric acid solutions by means of iron, being in powder form when the reduction treatment is carried out in a reactor or in the form of scrap iron when the reduction treatment is carried out in a column.

After the reduction treatment has been carried out, the phosphoric acid solutions which contain solid matter in suspension are subjected to a separation operation before being brought into contact with the extracting agent in solution in an aliphatic and/or aromatic hydrocarbon.

The two organic and inorganic phases, to be extracted and extracting respectively, are then brought into intimate contact in the form of a fine emulsion which is rapidly broken in order to separate the uranium-charged organic phase from the inorganic acid phase, from which the uranium has been removed.

The uranium-charged organic phase is then treated with an aqueous solution of hydrofluoric acid, that solution containing from 10% to 20% but preferably from 14% to 18% by weight of free HF.

The temperature at which the step of re-extracting uranium by means of hydrofluoric acid is effected is from 0° to 60° C. but preferably from 10° to 30° C., at which temperature the degree of degradation of alkylpyrophosphoric acid is still low (less than 2%).

The uranium then precipitates in the form of $UF_4$ which is separated from the liquid medium by any suitable means selected from those known to the man skilled in the art.

The alkylpyrophosphoric acid, from which the uranium has been removed, is then directly recycled to the step of extracting the uranium contained in phosphoric acid solutions, possibly after adding a make-up amount of fresh alkylpyrophosphoric acid, while the solutions of phosphoric acids, from which the uranium has been removed, are themselves subjected to a centrifuging operation in order to recover the mechanically entrained extracting agent.

The invention will be better appreciated by reference to the following Examples illustrating same.

EXAMPLE 1

This Example illustrates the process for extracting uranium, according to the invention, by means of alkylpyrophosphoric acids, in comparison with the extracting process which is most widely employed among the processes constituting the prior art.

For that purpose, a Togoland-Morocco phosphoric acid of the following composition was treated:

$P_2O_5$ (28%): 360 g/l $SO_4$: 14 g/l

F: 15.6 g/l

Fe: 9.3 g/l

U: 120 mg/l

That acid is reduced either by means of iron powder form in an agitated tank, in regard to Tests 1 to 4, or in a column, by means of iron in plate form, in regard to Tests 5 and 6.

The reduced phosphoric acid contains Fe II and Fe III in a Fe II/Fe III ratio of from 5 to 5.3.

The phosphoric acid is treated by the extracting agent in solution in kerosine in a proportion of 30 g/l. The flow rate of reduced phosphoric acid was 200/h while that of the extracting agent solution was 20 l/h.

The uranium-charged solvent, after separation thereof from the phosphoric acid from which the uranium was removed, was cooled to 20° C. and then treated with a 15% HF solution, at a flow rate of 2 l/h.

The solvent from which the uranium was removed was recycled to the extraction operation after adding a fraction hour of the extracting agent.

Test No 1 which illustrates the prior art was carried out in an industrial installation in which the extending unit was formed by an array of four mixer-settlers; in the extracting unit, the sum of the periods of time $T_1$ and $T_2$ for four stages, as defined in the process according to the invention, is 14 hours.

Test No 2 which illustrates the invention was carried out in an industrial installation in which the extracting unit was formed by a multi-stage centrifugal extractor having four stages, rotating at a speed of 2 800 revolutions per minute, in which the sum of the residence times $T_1$ and $T_2$ for four stages was less than 2 minutes.

Test No 3 which illustrates the prior art differs from Test No 1 by virtue of the nature of the extracting agent which in this case was a solution of ethylhexylpyrophosphoric acid.

Test No 4 which illustrates the invention differs from Test No 2 by virtue of the nature of the extracting agent which was ethylhexylpyrophosphoric acid.

Test No 5 which illustrates the prior art differs from Test No 1 only in regard to the method of reducing the phosphoric acid (over plates, in a column).

Test No 6 which illustrates the invention differs from Test No 2 in regard to the method of reducing the phosphoric acid and in regard to the constitution of the extraction unit which comprised four single-stage centrifugal extractors in a battery arrangement, in which unit the sum of the residence times $T_1$ and $T_2$ was less than 2 minutes.

All the results are set out in Table I below:

TABLE 1

| | Test 1 | Test 2 | Test 3 | Test 4 | Test 5 | Test 6 |
|---|---|---|---|---|---|---|
| Nature of the process | prior | invention | prior | invention | prior | invention |
| Extracting agent | Octylpyrophosphoric acid | | Ethylhexylpyrophosphoric acid | | Octylpyrophosphoric acid | |
| Sum: $n(T_1 + T_2)$ in minutes | 840 | <6 min | 840 | <6 min | 840 | <6 min |
| Proportion of uranium in $H_3PO_4$ after extraction in mg/l | 10 mg/l | 2 mg/l | 12 mg/l | 6 mg/l | 12 mg/l | 7 mg/l |
| Fresh extracting agent added in each cycle in g/l | 10 g/l | 2.5 g/l | 12 g/l | 2 g/l | 11 g/l | 2 g/l |

On the basis of the results which are thus set forth in the Table, it is possible to measure the importance of the process according to the invention which provides for an improvement in the uranium extraction yield but reduces the consumption of extracting agent by from 5 to 6 times.

EXAMPLE 2

This Example illustrates the process for extracting uranium according to the invention, by means of alkylpyrophosphoric acids, in comparison with the extraction process which is most widely used among the processes constituting the prior art.

It is concerned with treating a phosphoric acid of Tunisian origin, having a low uranium content.

The phosphoric acid treated was of the following composition:

$P_2O_5$ (28%): 360 g/l

Fe: 1.9 g/l

U: 40 mg/l

Test No 7 which illustrates the prior art was carried out, as Test No 1, in an array of 4 mixer-settlers.

Test No 8 which illustrates the invention was carried out like Test No 2, but using an array comprising three single-stage centrifugal extracters.

The results are set out in Table 2 below:

TABLE 2

| | Test 7 | Test 8 |
|---|---|---|
| Nature of the process | prior art | invention |
| Extracting agent | Octylpyrophosphoric acid | |

TABLE 2-continued

| | Test 7 | Test 8 |
|---|---|---|
| Sum: $n(T_1 + T_2)$ in minutes | 840 | <4.5 min |
| Proportion of uranium in $H_3PO_4$ after extraction in mg/l | 4 mg/l | <2 mg/l |
| Fresh extracting agent added in each cycle in g/l | 10 g/l | 2 g/l |

This second Table confirms the excellent results obtained with Example 1.

I claim:

1. A process for extracting uranium contained in solutions of phosphoric acids by means of an extracting agent comprising an alkylpyrophosphoric acid, which process comprises bringing into contact, the inorganic, phosphoric acid phase and an organic phase containing the extracting agent, thereby producing an emulsion, wherein the emulsion is produced in a first step by simultaneously subjecting the two phases containing the phosphoric acid and the extracting agent for a period of time $T_1$ to an intense mechanical sheering action corresponding to a sheering coefficient of at least 5000 seconds$^{-1}$, thereby increasing the contact surfaces for contact between said two phases, and then abruptly breaking said emulsion, in a second step, in a time $T_2$, the sum $T_1+T_2$ of the times required for carrying out the two steps being at most 20 minutes.

2. A uranium extraction process according to claim 1 wherein said emulsion is produced in an extraction unit which comprises from 2 to 20 stages in a cascade configuration.

3. A uranium extraction process according to claim 1 wherein said emulsion is produced in an extraction unit in a single stage.

4. A uranium extraction process according to any one of claims 1 to 3 wherein said shearing coefficient is selected to fall in the range of from 5000 seconds$^{-1}$ to 50 000 seconds$^{-1}$.

5. A uranium extraction process according to claim 1 wherein the sum $T_1+T_2$ of the times required for carrying out the two steps is preferably at most 10 minutes for an extraction stage.

6. A uranium extraction process according to claim 1 wherein the ratio $T_1/T_2$ of the times for carrying out the two steps for an extraction stage is selected within the limits of from 1/100 to 5/1.

7. A uranium extraction process according to claim 1 wherein the extracting agent which is an alkylpyrophosphoric acid is produced by the addition $P_2O_5$ to an alcohol having a $C_7$ to $C_{13}$ carbon chain.

8. A uranium extraction process according to claim 7 wherein the alkylpyrophosphoric acid production temperature is from 30° C. to 80° C.

9. A uranium extraction process according to claim 1 wherein the uranium-charged organic phase resulting from the second step is treated with a hydrofluoric acid solution for re-extracting the uranium.

10. A uranium extraction process according to claim 9 wherein the hydrofluoric acid solution contains from 10 to 20% by weight but preferably from 13 to 18% by weight of HF.

11. A uranium extraction process according to claim 9 wherein the temperature at which the operation of re-extraction of uranium by means of hydrofluoric acid is performed is from 0° C. to 60° C. and preferably from 10° C. to 30° C.

12. A uranium extraction process according to claim 1 wherein the extracting agent which is entrained by phosphoric acid is recovered by centrifuging.

13. A uranium extraction process according to claim 4 wherein said shearing coefficient is in the range from 10 000 seconds$^{-1}$ to 25 000 seconds$^{-1}$.

14. A uranium extraction process according to claim 4 wherein the sum $T_1+T_2$ of the times required for carrying out the two steps is at most 10 minutes for an extraction stage.

15. A uranium extraction process according to claim 1 wherein the ratio $T_1/T_2$ of the times for carrying out the two steps for an extraction stage is selected within the limits from 1/25 to 2/1.

16. A uranium extraction process according to claim 7 wherein the alkylpyrophosphoric acid production temperature is from 30° C. to 40° C.

* * * * *